US008986025B2

(12) United States Patent
Li et al.

(10) Patent No.: US 8,986,025 B2
(45) Date of Patent: Mar. 24, 2015

(54) PLUG DEVICE FOR CONNECTORS

(71) Applicants: Hong Fu Jin Precision Industry (ShenZhen) Co., Ltd., Shenzhen (CN); Hon Hai Precision Industry Co., Ltd., New Taipei (TW)

(72) Inventors: Zhan-Yang Li, Shenzhen (CN); Chong Duan, Shenzhen (CN)

(73) Assignee: Zhongshan Innocloud Intellectual Property Services Co., Ltd., Zhongshan (CN)

( * ) Notice: Subject to any disclaimer, the term of this patent is extended or adjusted under 35 U.S.C. 154(b) by 35 days.

(21) Appl. No.: 13/972,892

(22) Filed: Aug. 21, 2013

(65) Prior Publication Data

US 2014/0187069 A1 Jul. 3, 2014

(30) Foreign Application Priority Data

Dec. 27, 2012 (CN) ..... 2012 1 0577715

(51) Int. Cl.

| | |
|---|---|
| ***H01R 13/62*** | (2006.01) |
| ***H01R 13/629*** | (2006.01) |
| ***H01R 43/26*** | (2006.01) |
| *H01R 12/73* | (2011.01) |

(52) U.S. Cl.

CPC ..... *H01R 13/62977* (2013.01); *H01R 43/26* (2013.01); *H01R 12/732* (2013.01)

USPC ..... 439/160

(58) Field of Classification Search

USPC ..... 439/160, 159, 152, 680, 242, 284, 439/286–291, 293–295, 157, 460, 372

See application file for complete search history.

(56) References Cited

U.S. PATENT DOCUMENTS

| | | | | |
|---|---|---|---|---|
| 5,848,906 | A * | 12/1998 | Glusker et al. | 439/157 |
| 6,190,192 | B1 * | 2/2001 | White et al. | 439/292 |
| 6,746,158 | B2 * | 6/2004 | Merrick | 385/53 |
| 2004/0023535 | A1 * | 2/2004 | Gundermann et al. | 439/157 |

* cited by examiner

*Primary Examiner* — Edwin A. Leon

(74) *Attorney, Agent, or Firm* — Novak Druce Connolly Bove + Quigg LLP

(57) ABSTRACT

A plug device, for engaging a first connector with a second connector or disengaging the first connector from the second connector, includes a base, an operation platform, a sliding member, and an operation assembly. The operation platform is secured to the base. The operation platform is used for securing the second connector and support the first connector. The sliding member is used for grasping the first connector. The operation assembly includes a handle. The handle is rotatable relative to the base to slide the sliding member relative to the operation platform, so that the first connector is engaged with the second connector or disengaged from the second connector.

20 Claims, 6 Drawing Sheets

PLUG DEVICE FOR CONNECTORS

BACKGROUND

1. Technical Field

The present disclosure relates to plug devices, and particularly to a plug device for two connectors.

2. Description of Related Art

Generally, a first connector is manually inserted into or extracted from a second connector. However, if an insertion force and an extraction force are uneven, damage may be caused to the two connectors when in assembly or disassembly. Therefore, there is room for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
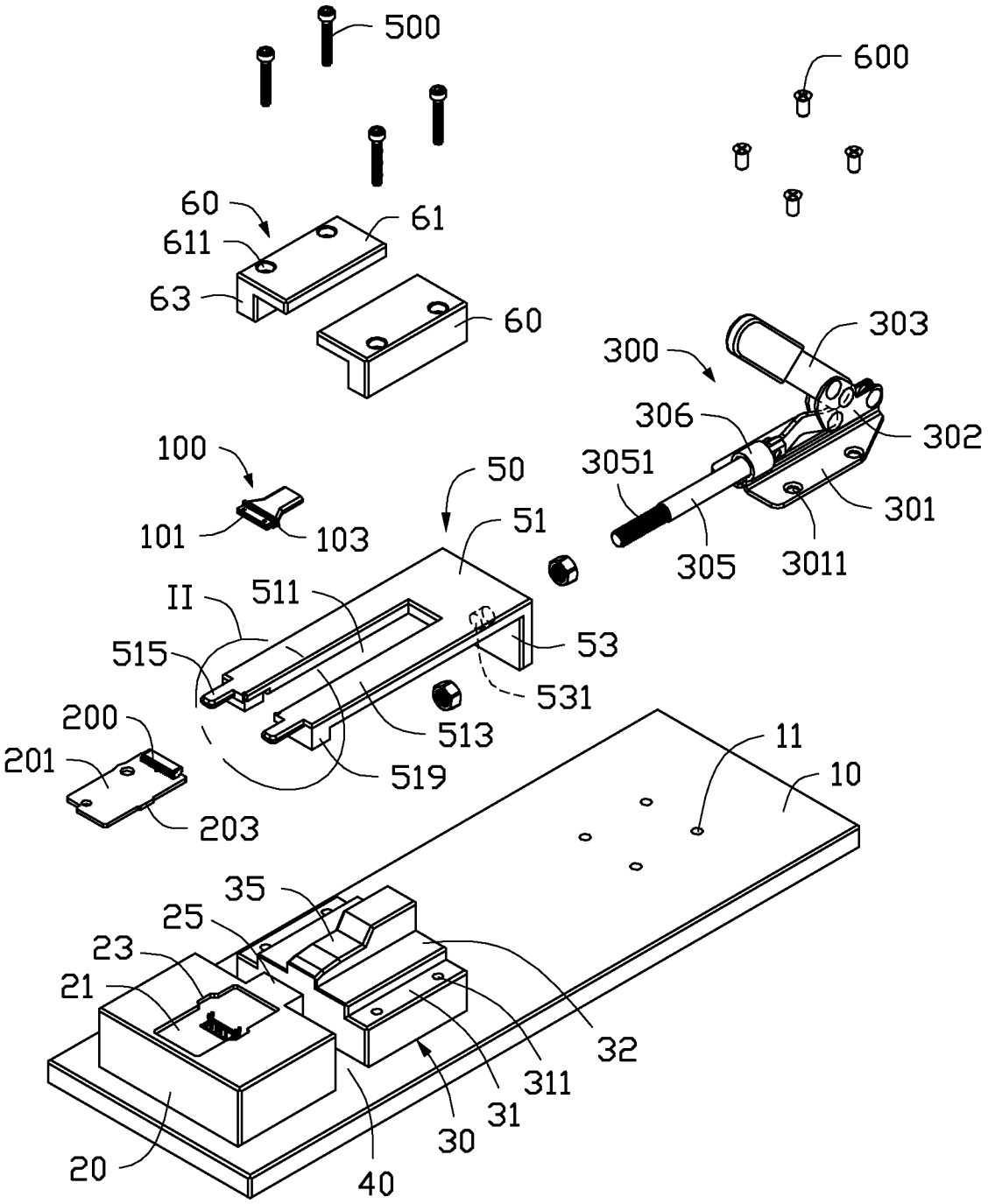
FIG. 1 is an exploded, isometric view of one embodiment of a plug device.

FIG. 1 shows one embodiment of a plug device for inserting a first connector 100 into a second connector 200 or disengaging the first connector 100 from the second connector 200. The first connector 100 includes a body 101 and a protrusion 103 extending outwards from the body 101. The second connector 200 is secured to a circuit board 201. The circuit board 201 includes a limiting tab 203. In one embodiment, the first connector 100 is cable terminals.

The plug device includes a base 10, an operation platform 20, a guiding rail 30, a sliding member 50, two pressing blocks 60, and a handling assembly 300.

The base 10 defines a plurality of first locking holes 11. The operation platform 20 and the guiding rail 30 are secured to the base 10. The operation platform 20 defines a receiving slot 21 and two limiting slots 23 extending from opposite edges of the receiving slot 21.

The guiding rail 30 is step-shaped and includes a mounting base 31, a holding block 32 extending from the mounting base 31, and a limiting block 35 extending from the holding block 32. The mounting base 31 defines a plurality of mounting holes 311 located on opposite sides of the holding block 32. A sliding channel 40 is defined between the guiding rail 30 and the operation platform 20. A placing platform 25 extends from the operation platform 20 into the sliding channel 40. The placing platform 25 is used for the placement of the first connector 100.

Figure 2:
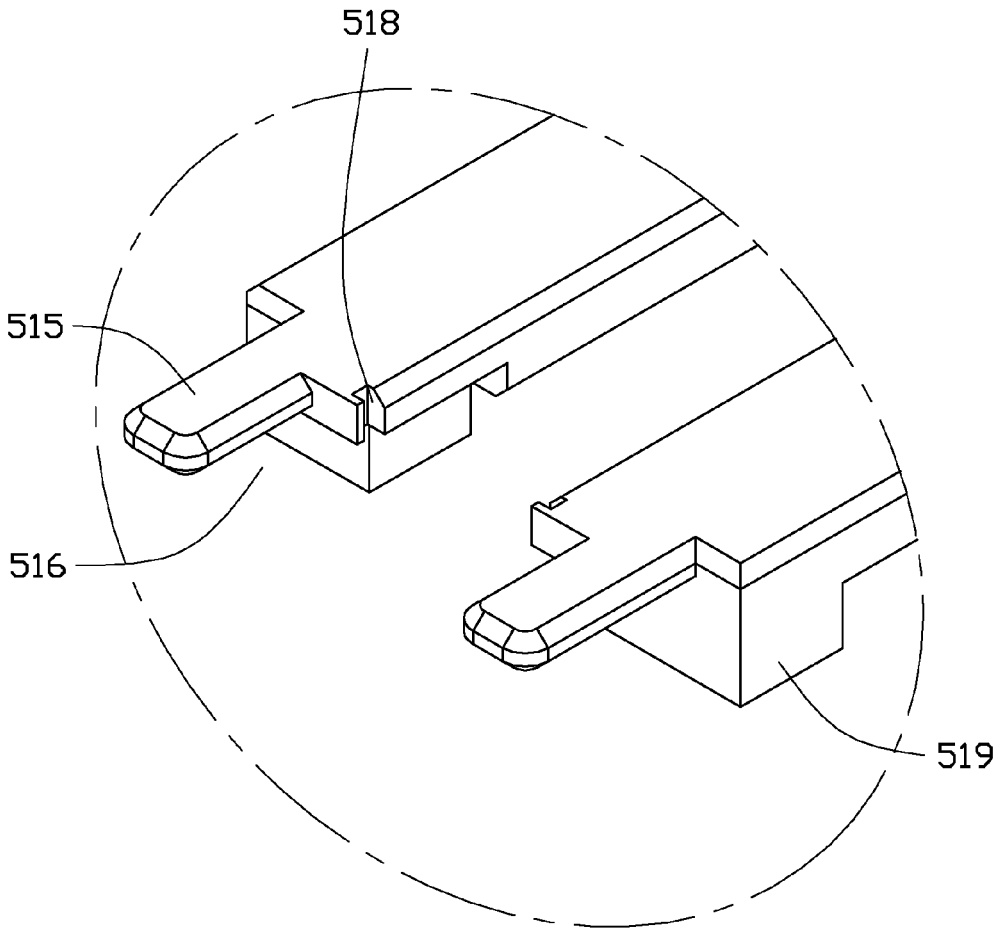
FIG. 2 is an enlarged view of a circled portion II of the plug device of FIG. 1.

FIGS. 1 and 2 show the sliding member 50 including a sliding plate 51 and a mounting plate 53 extending downwards from a first end of the sliding plate 51. A second end of the sliding plate 51 defines a sliding slot 511, to form two sliding arms 513 on opposite sides of the sliding slot 511. An extension piece 515 extends substantially parallel from each sliding arm 513 away from the mounting plate 53. A positioning block 519 extends downwards from a bottom surface of each sliding arm 513. The extension piece 515 defines a cutout 516. Each sliding arm 513 defines a positioning slot 518 communicating with the sliding slot 511. The positioning slot 518 is used for engaging with the limiting protrusion 103. The mounting plate 53 defines an installation hole 531.

Each pressing block 60 includes a resisting block 61 and a mounting block 63, that is substantially perpendicularly connected to the resisting block 61. The resisting block 61 defines two through holes 611 extending through the mounting block 63.

The handling assembly 300 includes a securing base 301, a rotating piece 302, a handle 303, and a sliding post 305. The securing base 301 defines a plurality of second locking holes 3011 corresponding to the plurality of first locking holes 11. A socket 306 is located on the securing base 301. The rotating piece 302 is rotatably mounted to the securing base 301. The handle 303 is secured to the rotating piece 302. The sliding post 305 is slidably received in the socket 306 with a first end rotatably mounted to the rotating piece 302. A second end of the sliding post 305 includes a threaded portion 3051. The handle 303 is rotatable relative to the securing base 301 to slide the sliding post 305 in the socket 306 via the rotating piece 302.

Figure 3:
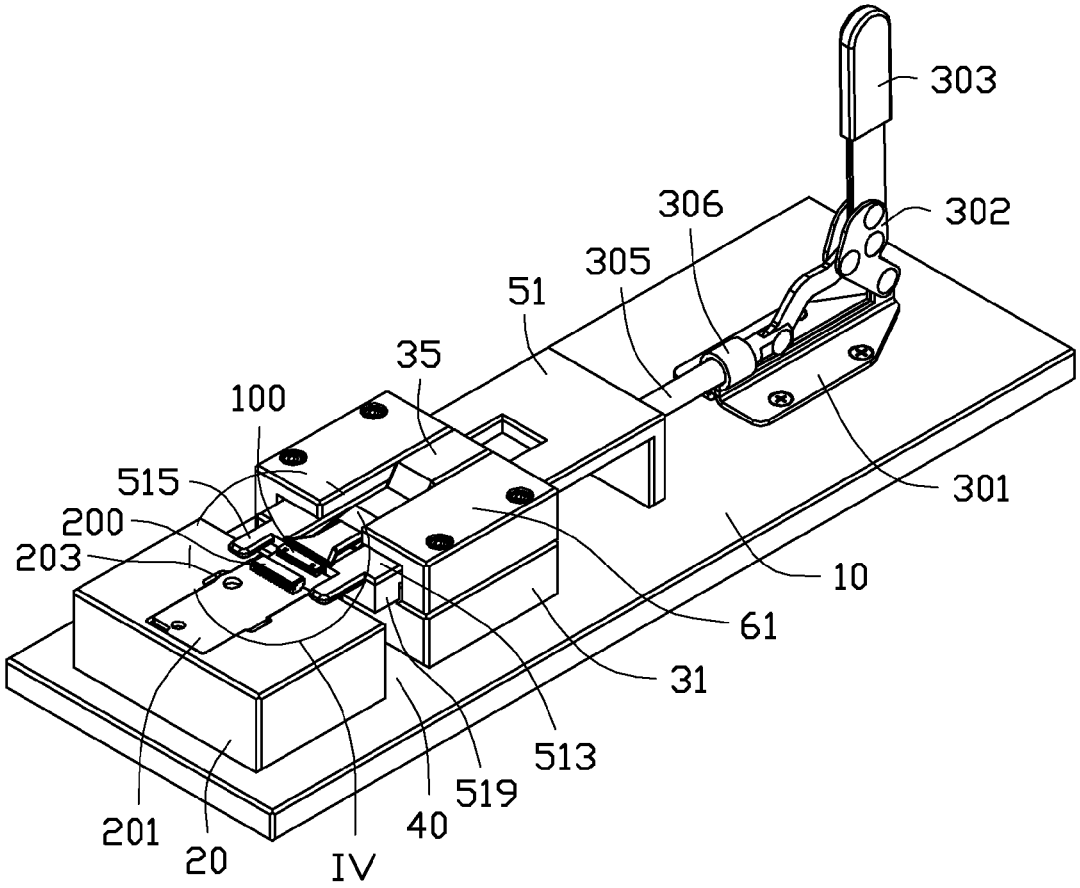
FIG. 3 is an assembled, isometric view of the plug device of FIG. 1, with a handle in a first position and a first connected disengaged from the second connector.
Figure 4:
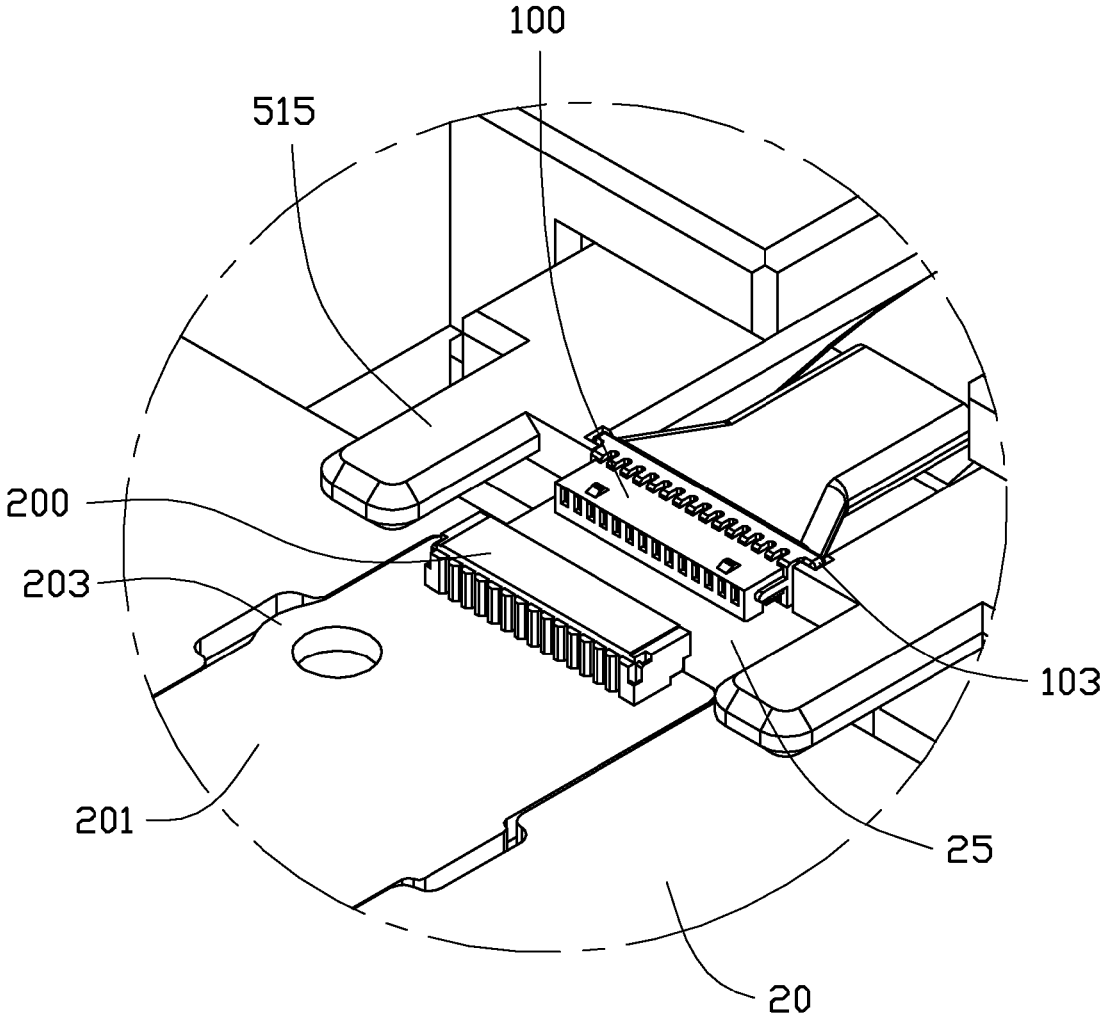
FIG. 4 is an enlarged view of a circled portion IV of the plug device of FIG. 3.
Figure 5:
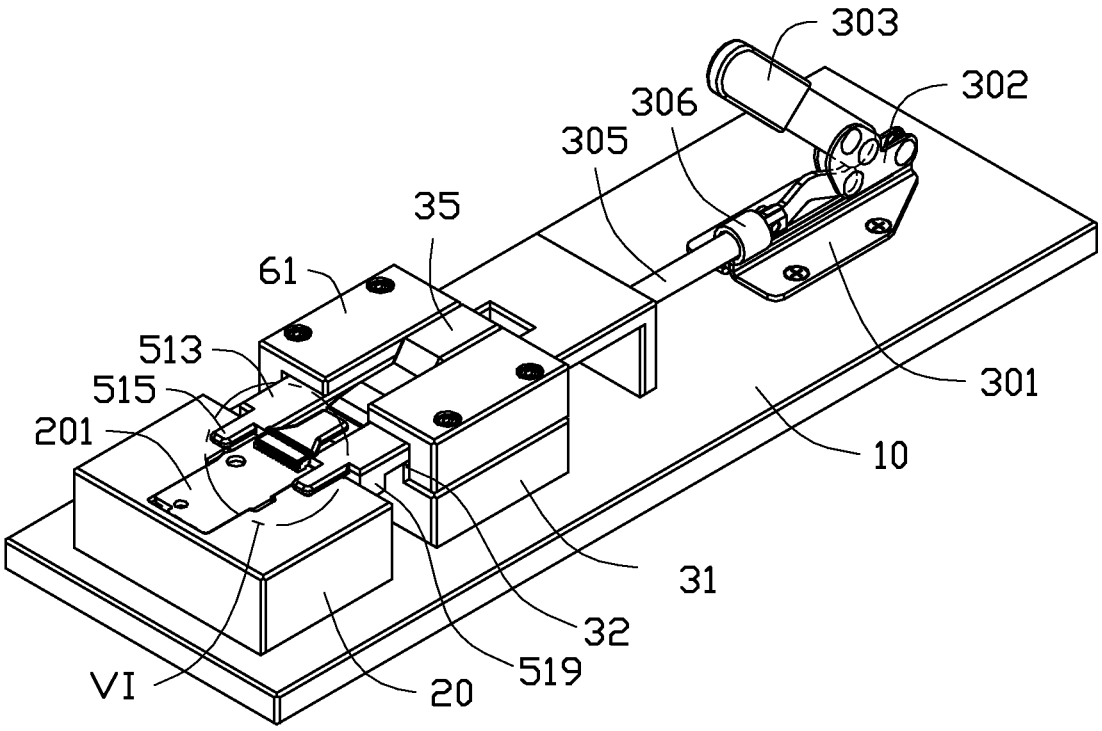
FIG. 5 is another assembled, isometric view of the plug device of FIG. 1, with the handle in a second position and the first connected engaged with the second connector.
Figure 6:
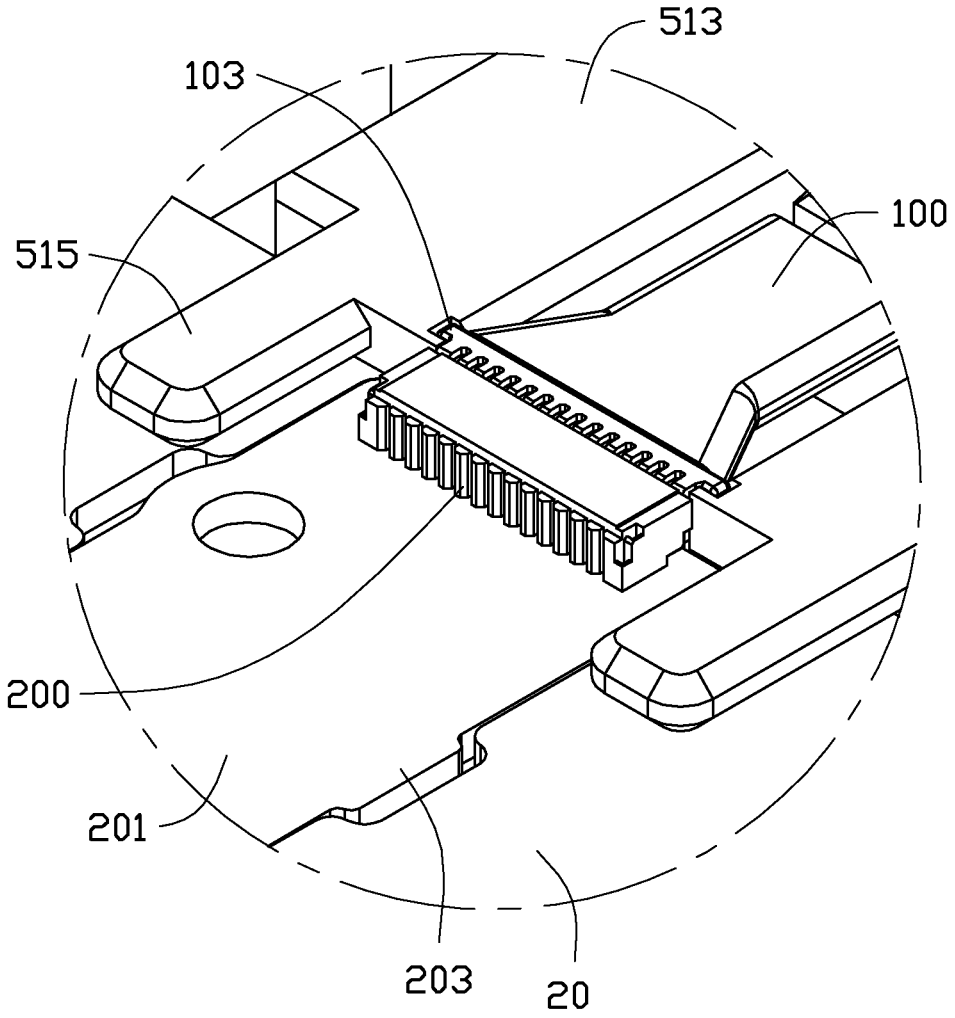
FIG. 6 is an enlarged view of a circled portion VI of the plug device of FIG. 5.

FIG. 3 shows that, in assembly, the sliding member 50 is moved to be adjacent to the guiding rail 30 with the sliding arm 513 abutting the holding block 32. The limiting block 35 is located in the sliding slot 511, and the positioning block 519 is located in the sliding channel 40. The extension piece 515 abuts the operation platform 20. The handling assembly 300 is moved to be adjacent to the base 10. A plurality of first locking members 600 are inserted through the second locking holes 3011 and the first locking holes 11 to secure the securing base 301 to the base 10. The threaded portion 3051 is threaded in the installation hole 531. A plurality of second locking members 500 are inserted through the through holes 611 and the mounting holes 311, to secure the pressing blocks 60 to the guiding rail 30. The resisting block 61 is above the sliding arm 513 to prevent the sliding arm 513 from moving upwards when sliding. In other embodiments, the socket 306 is secured to the base 10 directly, and the rotating piece 302 is rotatably mounted to the base 10 directly.

The handle 303 is operable to slide the sliding member 50 between a first position and a second position. When the sliding member 50 is in the first position, a first angle is defined between the handle 303 and the base 10, the positioning block 519 abuts the guiding rail 30, and a first distance is defined between the mounting plate 53 and the guiding rail 30. When the sliding member 50 is in the second position, a second angle is defined between the handle 303 and the base 10, the positioning block 519 abuts the operation platform 20, and a second distance is defined between the mounting plate 53 and the guiding rail 30. The first angle is greater than the second angle. The first distance is greater than the second distance. An extending direction of each limiting slot 23 and the positioning slot 518 is substantially perpendicular to a sliding direction of the sliding member 50.

FIGS. 3-6 show that in use, the handle 303 is rotated to the first position, the first connector 100 is placed on the placing platform 25 between the two extension pieces 515. The limiting protrusion 103 is engaged in the positioning slot 518. The circuit board 201 is placed in the receiving slot 21, and the limiting tab 203 is engaged in the limiting slot 23. In assembly of the first connector 100 to the second connector 200, the handle 303 is rotated towards the base 10. The rotating piece 302 is rotated relative to the securing base 301 together with the handle 303 and slides the sliding post 305 in the socket 306. The sliding post 305 pushes the sliding member 50 to slide towards the operation platform 20, and the first connector 100 is pushed towards the second connector 200 then. Until the sliding member 50 is in the second position, the first connector 100 is connected to the second connector 200.

In disassembly of the first connector 100 from the second connector 200, the handle 303 is rotated away from the base 10, the rotating piece 302 is rotated relative to the securing base 301 together with the handle 303 and slides the sliding post 305 in the socket 306. The sliding post 305 pulls the sliding member 50 to slide away from the operation platform 20. The first connector 100 is then pulled away from the second connector 200. Until the sliding member 50 is in the first position, the first connector 100 is disengaged from the second connector 200.

It is to be understood, however, that even though numerous characteristics and advantages have been set forth in the foregoing description of embodiments, together with details of the structures and functions of the embodiments, the disclosure is illustrative only and changes may be made in detail, especially in the matters of shape, size, and the arrangement of parts within the principles of the disclosure, to the full extent indicated by the broad general meaning of the terms in which the appended claims are expressed.

What is claimed is:

1. A plug device, for engaging a first connector with a second connector or disengaging the first connector from the second connector, comprising:

a base;

an operation platform secured to the base and configured for securing the second connector and holding the first connector;

a sliding member configured for securing the first connector; and an handling assembly comprising a handle rotatably mounted to the base and a sliding post fixed to the sliding member and slidably mounted to the base;

wherein the handle is rotatable relative to the base to slide the sliding post; and the sliding post is slidable to slide the sliding member relative to the operation platform, which is configured to engage the first connector with the second connector or disengage the first connector from the second connector.

2. The plug device of claim 1, wherein the handling assembly further comprises a securing base secured to the base and a rotating piece rotatably mounted to the securing base; the handle is secured to the rotating piece; and the sliding post is rotatably mounted to the rotating piece.

3. The plug device of claim 2, wherein the handling assembly further comprises a socket secured to the securing base, and the sliding post is slidably received in the socket.

4. The plug device of claim 1, further comprising a guiding rail, wherein the guiding rail comprises a mounting base, a holding block located on the mounting base, and a limiting block located on the holding block; the sliding member comprises a sliding plate, which defines a sliding slot and comprises two sliding arms on opposite sides of the sliding slot; the two sliding arms abut the holding block; and the limiting block is received in the sliding slot.

5. The plug device of claim 4, wherein the guiding rail further comprises an extension piece extending from each sliding arm, and the extension piece abuts the operation platform.

6. The plug device of claim 4, wherein each sliding arm defines a positioning slot communicating with the sliding slot, and the positioning slot is configured for engaging limiting protrusion protruding from the first connector.

7. The plug device of claim 6, wherein the operation platform defines a receiving slot and two limiting slots extending from opposite edges of the receiving slot; the receiving slot is configured for receiving a circuit board, which is configured for securing the second connector; and each limiting slot is configured for engaging a limiting tab extending from the circuit board.

8. The plug device of claim 7, wherein an extending direction of each of the limiting slot and the positioning slot is substantially perpendicular to a sliding direction of the sliding member.

9. The plug device of claim 4, wherein the guiding rail further comprises a positioning block extending from a bottom surface of each sliding arm; a sliding channel is defined between the operation platform and the guiding rail; the positioning block is received in the sliding channel; and the positioning block is slidable in the sliding channel when the sliding member is slid relative to the operation platform.

10. The plug device of claim 4, further comprising a pressing block, wherein the pressing block comprises a resisting block and a mounting block extending from the resisting block; the mounting block is substantially perpendicularly to the resisting block, the mounting block is secured to the mounting base, and each sliding arm is slidable between the pressing block and the holding block.

11. A plug device, for engaging a first connector with a second connector or disengaging the first connector from the second connector, comprising:

a base;

an operation platform secured to the base and configured for securing the second connector and holding the first connector;

a sliding member configured for securing the first connector; and an handling assembly comprising a handle rotatably mounted to the base and a sliding post fixed to the sliding member and slidably mounted to the base;

wherein the handle is rotatable relative to the base to slide the sliding member between a first position and a second position; when the sliding member is in the first position, a first angle is defined between the handle and the base, and a first distance is defined between the sliding member and the operation platform; when the sliding member is in the second position, a second angle is defined between the handle and the base, and a second distance is defined between the sliding member and the operation platform; the first angle is greater than the second angle; and the first distance is greater than the second distance.

12. The plug device of claim 11, wherein the handling assembly further comprises a securing base secured to the base and a rotating piece rotatably mounted to the securing base; the handle is secured to the rotating piece; and the sliding post is rotatably mounted to the rotating piece.

13. The plug device of claim 12, wherein the handling assembly further comprises a socket secured to the securing base, and the sliding post is slidably received in the socket.

14. The plug device of claim 11, further comprising a guiding rail, wherein the guiding rail comprises a mounting base, a holding block located on the mounting base, and a limiting block located on the holding block; the sliding member comprises a sliding plate, which defines a sliding slot and comprises two sliding arms on opposite sides of the sliding slot; the two sliding arms abut the holding block; and the limiting block is received in the sliding slot.

15. The plug device of claim 14, wherein the guiding rail further comprises an extension piece extending from each sliding arm, and the extension piece abuts the operation platform.

16. The plug device of claim 14, wherein each sliding arm defines a positioning slot communicating with the sliding slot, and the positioning slot is configured for engaging limiting protrusion protruding from the first connector.

17. The plug device of claim 16, wherein the operation platform defines a receiving slot and two limiting slots extending from opposite edges of the receiving slot, the receiving slot is configured for receiving a circuit board, which is configured for securing the second connector; and each limiting slot is configured for engaging a limiting tab extending from the circuit board.

18. The plug device of claim 17, wherein an extending direction of each of the limiting slot and the positioning slot is substantially perpendicular to a sliding direction of the sliding member.

19. The plug device of claim 14, wherein the guiding rail further comprises a positioning block extending from a bottom surface of each sliding arm; a sliding channel is defined between the operation platform and the guiding rail; the positioning block is received in the sliding channel; and the positioning block is slidable in the sliding channel when the sliding member is slid relative to the operation platform.

20. The plug device of claim 14, further comprising a pressing block, wherein the pressing block comprises a resisting block and a mounting block extending from the resisting block; the mounting block; the mounting block is substantially perpendicularly to the resisting block, the mounting block is secured to the mounting base, and each sliding arm is slidable between the pressing block and the holding block.

* * * * *